United States Patent [19]

Shimai

[11] Patent Number: 4,838,097

[45] Date of Patent: Jun. 13, 1989

[54] DETECTING APPARATUS FOR DETECTING REINFORCING STRIP ON SLIDE FASTENER CHAIN

[75] Inventor: Hideo Shimai, Namerikawa, Japan

[73] Assignee: Yoshida Kogyo K. K., Tokyo, Japan

[21] Appl. No.: 229,851

[22] Filed: Aug. 8, 1988

[30] Foreign Application Priority Data

Aug. 10, 1987 [JP] Japan ..... 62-122403[U]

[51] Int. Cl.[4] ..... G01M 19/00

[52] U.S. Cl. ..... 73/865.9; 73/865.8

[58] Field of Search ..... 73/865.9, 865.8; 24/381; 29/766, 408

[56] References Cited

U.S. PATENT DOCUMENTS

| | | | |
|---|---|---|---|
| 4,324,034 | 4/1982 | Berry et al. | 29/410 |
| 4,392,291 | 7/1983 | Iai | 29/766 X |
| 4,594,925 | 6/1986 | Ishikawa | 83/921 X |
| 4,619,141 | 10/1986 | Yoshiada et al. | 73/865.9 |
| 4,671,122 | 6/1987 | Igarashi | 73/865.9 X |

FOREIGN PATENT DOCUMENTS

| | | |
|---|---|---|
| 0111305 | 6/1984 | European Pat. Off. . |
| 7428064.1 | 3/1975 | Fed. Rep. of Germany . |
| 2412894 | 7/1979 | France . |

*Primary Examiner*—Tom Noland

*Attorney, Agent, or Firm*—Hill, Van Santen, Steadman & Simpson

[57] ABSTRACT

An apparatus for detecting the presence and position of a reinforcing strip on a continuous slide fastener chain comprises a detecting probe connected to and rotatable with a lever member into and out of the path of the fastener chain travelling undirectionally in an assembling line. The lever member is biased normally counterclockwise with a pressure adjusted to allow the probe to pass through the fabric web of the fastener tape but not through the reinforcing strip. A position detector is operatively associated with the lever member and responsive to the position or operation of the probe for discontinuing the operation of the apparatus.

6 Claims, 2 Drawing Sheets

DETECTING APPARATUS FOR DETECTING REINFORCING STRIP ON SLIDE FASTENER CHAIN

BACKGROUND OF THE INVENTION

1. Field of the Invention

This invention relates to a detecting apparatus for detecting a reinforcing strip of film applied to a slide fastener and more particularly to such an apparatus which is capable of detecting the presence and position of a reinforcing strip on a continuous chain of slide fasteners during the course of manufacture thereof.

2. Prior Art

There are known various types and forms of slide fastener, one of which is a so-called separable slide fastener equipped with a separable pin and box member at that end portion of the fastener which is reinforced as by fusion of a strip of a thermoplastic film to provide sufficient rigidity to withstand repeated manipulation of the separator. The reinforced end portion is notched for mounting the separator, and the fastener chain thus assembled is then cut into individual product lengths. However, in the event of failure to attach the film strips or misalignment thereof relative to the fastener, the result would be a defective slide fastener product.

It has been proposed in the art to detect the presence of the reinforcing strip on the fastener chain by sensing the thickness differential of the fastener tape, the thickness of the tape portion at which the strip is attached being greater than that of the tape web. However, this method of detection is not wholly satisfactory because of the aforesaid thickness differential being so small that the detection, if not impossible, would be often subject to error or malfunction. Attempts to eliminate such malfunction would involve expensive, high-precision, structurally complicated detecting devices.

SUMMARY OF THE INVENTION

It is therefore the primary object of the present invention to overcome the difficulties encountered in the prior art.

It is a more specific object of the invention to provide an apparatus for detecting presence and position of reinforced tape end portions at predetermined intervals along the length of a continuous slide fastener chain, which apparatus is relatively simple in construction and highly reliable in operation.

The apparatus according to the invention comprises a detecting apparatus for detecting the presence and position of a reinforcing strip on a continuous slide fastener chain having a pair of tapes and coupling elements, which apparatus comprises: a pair of identical lever means each rotatable between a horizontal retracted position and a downwardly tilted operative position and having at one end a vertically extending detecting probe movable into and away from the passage of the slide fastener chain; a position detecting means responsive to the operation of said lever means for discontinuing the operation of said apparatus; a shutter means connected to and rotatable with said lever means for coming into and out of intercepting relation to said position detecting means; and a biasing means normally urging said probe counterclockwise toward the passage of the fastener chain, said biasing means having a biasing force adjusted to an extent to allow said probe to pass through the fastener tape but not through the reinforcing strip.

The above and other objects and features of the invention will be better understood from the following description taken in conjunction with the accompanying drawings in which like reference numerals refer to like or corresponding parts throughout the several views.

DETAILED DESCRIPTION

Figure 1:
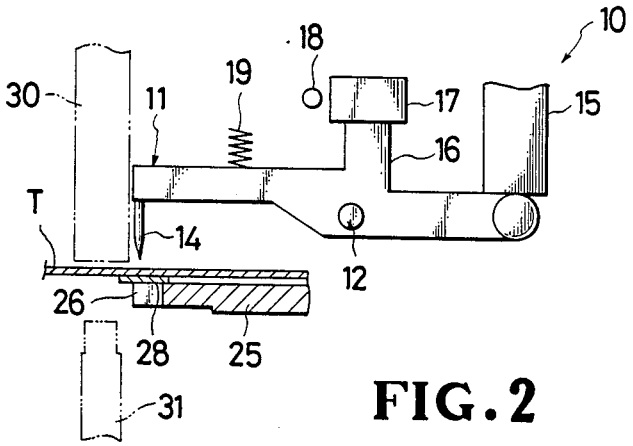
FIG. 1 is a schematic side elevation of part of the apparatus embodying the invention, showing the same in one mode of operation.
Figure 4:
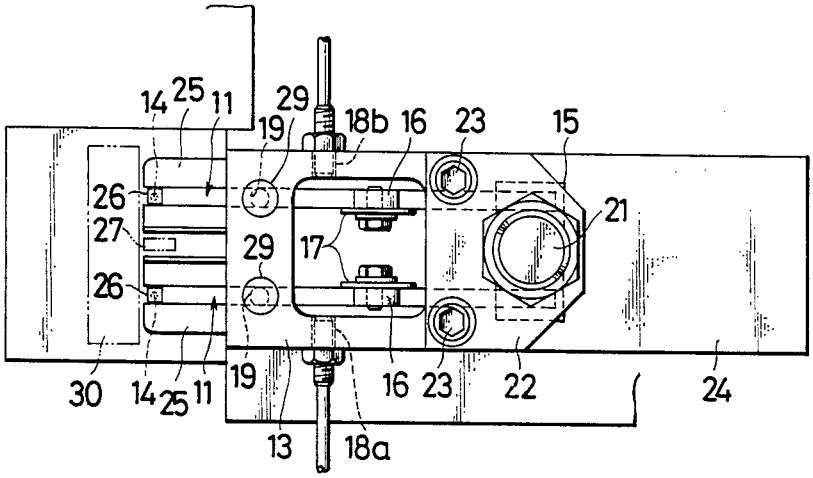
FIG. 4 is a plan view of the apparatus according to the invention.
Figure 5:
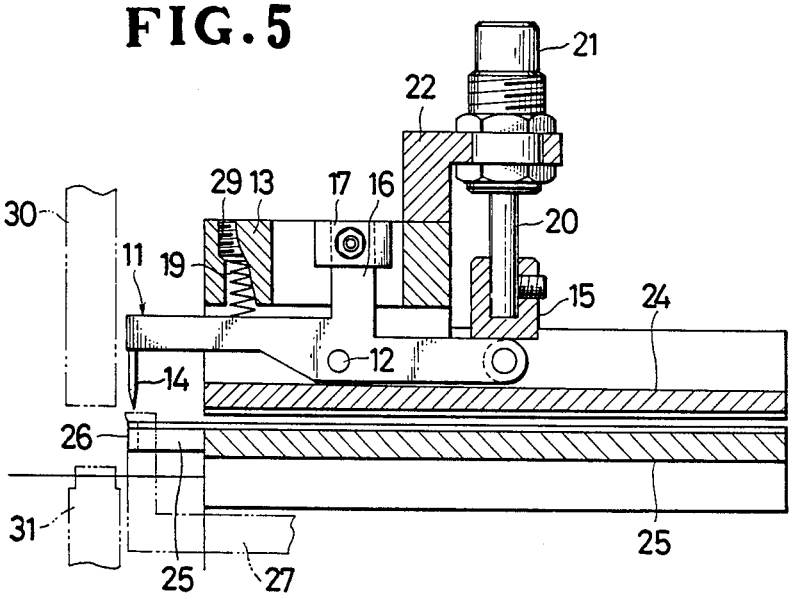
FIG. 5 is a side elevational, partly sectional, view of the apparatus.

Referring now to the drawings and FIG. 1 in particular, there is shown a major operating component of the apparatus 10 of the invention which comprises a pair of identical parallel operating lever means 11 each pivotally connected via pin 12 to a vertical support frame 13 (FIGS. 4 and 5). The lever means 11 are rotatable about the pin 12 between a horizontal retracted position shown in FIG. 1 and a downwardly tilted operative position. Each of the lever means 11 has a downwardly vertically extending detecting probe 14 secured at right angles to one end of the lever means 11 and movable into and away from the passage of a slide fastener chain F with rotation of the lever means 11. At the other or opposite end of the lever means 11, there is provided a limiter 15 which is vertically movable toward and away from the lever means 11 and normally holds the latter in the horizontal retracted position. A vertical support lug 16 extends centrally from each of the lever means 11 and is adapted to support thereon a shutter means 17 adjacent to a position detecting means 18. Intermediate between the support lug 16 and the probe 14 is provided a biasing means 19 secured to the support frame 13 and normally urging the probe 14 counterclockwise toward the passage of the fastener chain F.

The position detecting means 18 is responsive to the operation of the lever means 11 for discontinuing and resuming the movement of the fastener chain F, and comprises a light-emitting element **18*a* such as a light-emitting diode and a light receiving element 18*b* such as a phototransistor, the two elements 18*a*, 18*b* being diametrically opposed across the parallel lever means 11 as better shown in FIG. 4**.

The limiter 15 is connected via connecting rod 20 to an actuating means such as an air cylinder 21 mounted on an L-shaped block 22 bolted as at 23 to the support frame 13.

The vertical support frame 13 is secured to an upper fastener chain guide member 24 which is connected to a lower fastener chain guide member 25 at an end not shown, the latter member 25 being supported on a base not shown. The two guide members 24, 25 extend horizontally in spaced apart relation to provide a constricted path therebetween for the passage of the fastener chain F as is well known in the art. The lower guide member 25 is provided at one end with a pair of recesses 26 for receiving the pair of probes 14 respectively.

A stopper means 27 is operatively associated with the apparatus 10 for detecting a selected position of the fastener chain F and stopping the latter temporarilly as it comes into abutting engagement with the fastener coupling elements E at the space or element-free section S of the chain F in a manner well known in the art. The stopper means 27 is positioned intermediate between the opposed probes 14 which are arranged to come into contact with an end portion of a reinforcing strip 28 which lies in close proximity to terminal ones E' of the coupling elements E on the fastener chain F.

Figure 3:
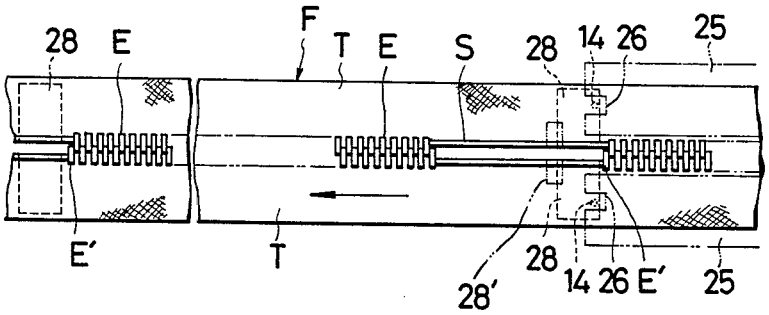
FIG. 3 is a plan view on an enlarged scale of a portion of a slide fastener chain.

As shown in FIG. 3, an individual slide fastener to be cut apart from the chain F comprises a pair of opposed tapes T, a row of coupling elements E secured to a longitudinal inner edge of each of the tape, a space section S devoid of coupling elements E and a reinforcing strip of film 28. The chain F travels unidirectionally as shown by the arrow in FIG. 3.

The biasing force of the biasing means 19, which is a compression spring in the illustrated embodiment, is adjusted by selecting its elastic coefficient and also by selecting the position of an adjusting screw 29 (FIG. 5) to which the spring 19 is connected. This adjustment should be made finely to allow the detecting probe 14 to thrust through the fabric web of the fastener tape T but not through the reinforcing strip 28. The hardness of the tape fabric is another factor to be considered in adjusting the biasing force or pressure of the spring 19.

Figure 2:
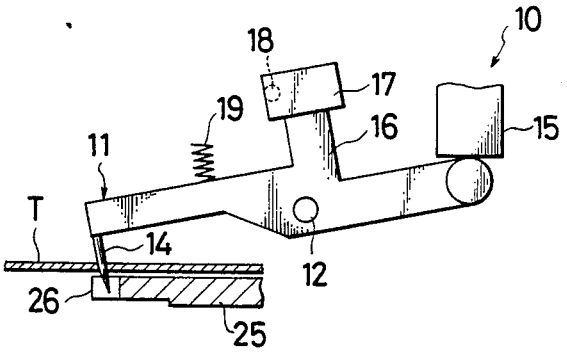
FIG. 2 is a view similar to FIG. 1 but showing the apparatus in another mode of operation.

In its retracted position, the lever means 11 is held substantially parallel to the path of the fastener chain F with the probe 14 pointing at right angles to but slightly spaced apart from the fastener tape T as shown in FIG. 1. The lever means 11 is so retained in this position by the limiter 15 which is held in abutting engagement with the rear end of the lever means 11 opposite to the probe 14. When the stopper means 27 is brought into abutting engagement with the fastener coupling elements E at a predetermined position, the movement of the fastener chain F is discontinued so that a control means not shown actuates the air cylinder 21 to move the limiter 15 upwardly apart from the lever means 11, whereupon the lever means 11 rotates counterclockwise under the influence of the biasing means 19 and the probe 14 penetrates through the fabric of the tape T. In this instance, if the reinforcing strip 28 is present in its proper position, the probe 14 abuts against and stops in contact with the strip 28 so that the line of communication between the oppositely disposed light-emitting and receiving elements **18*a* and 18*b* remains clear of interference with the shutter means 17. If the reinforcing strip 28 is absent or malaligned on either of the opposed tapes T, then the probe 14 moves further past through the tape T into the recess 26 in the lower guide member 25 as shown in FIG. 2, in which position the shutter means 17 intercepts the line of communication of the two elements 18*a*, 18*b*, causing the apparatus 10 to stop for the necessary corrective work. In the presence of the reinforcing strip 28 in proper position on the fastener chain F, it is provided with a notch 28' by a cutter means consisting of a punch 30 and a die 31 located adjacent to the probe 14 of the lever means 11**. The fastener chain F is continued to move on to further stations in an assembling line.

Since the operative or detecting position of the probe 14 is selected to lie in close proximity to the terminal coupling elements E', it is possible to detect departure or malalignment, if small, of the reinforcing strip 28 from the coupling elements E'.

The provision of a pair of detecting probes 14 makes it possible to make the intended detection for either one of the strips 28 independently from the other. Many changes and modifications may be made in the specific form and construction herein disclosed. For example, the biasing means 19 may be replaced by a spring wound on the pin 12, or a tension means adapted to pull the lever means 11 from near the limiter 15, or a weight attached to the lever means 11, or a balance utilizing the gravity of the lever means 11.

Further alternatively, the lever means 11 may be actuated by an air cylinder or a solenoid, or any other devices capable of providing a biasing pressure adjusted to allow the probe 14 pass through the fabric web of the tape T but not through the reinforcing strip 28.

The position detecting means 18 may be magnetically or statically functionable, or an ON-OFF microswitch.

The lever means 11 may be controlled in operational timing by a solenoid or a cam mechanism.

Obviously, various modifications and variations of the present invention are possible in the light of the above teaching. It is therefore to be understood that within the scope of the appended claims the invention may be practiced otherwise than as specifically described.

What is claimed is:

1. A detecting apparatus for detecting the presence and position of a reinforcing strip on a continuous slide fastener chain having a pair of tapes and coupling elements, which apparatus comprises:

(i) a pair of identical lever means, each rotatable between a horizontal retracted position and a downwardly tilted operative position and having at one end a vertically extending detecting probe movable into and away from the passage of the slide fastener chain;

(ii) a position detecting means responsive to the operation of said lever means for discontinuing the operation of said apparatus;

(iii) a shutter means connected to and rotatable with said lever means for coming into and out of intercepting relation to said position detecting means; and (iv) a biasing means normally urging said probe counterclockwise toward the passage of the fastener chain, said biasing means having a biasing force adjusted to an extent to allow said probe to pass through the fastener tape but not through the reinforcing strip.

2. An apparatus according to claim 1 in which said probe is positioned in close proximity to terminal ones of the coupling elements on the fastener chain.

3. An apparatus according to claim 1 in which said position detecting means comprises a light-emitting diode and a photo-transistor diametrically opposed thereto and establishing a line of communication therewith.

4. An apparatus according to claim 3 in which said shutter means is rotatable into and out of said line of communication of said position detecting means.

5. An apparatus according to claim 1, further including a limiter vertically movable toward and away from said lever means at the other end thereof for normally holding said lever means in the horizontal retracted position.

6. An apparatus according to claim 5 in which said limiter is connected to and moved by an air cylinder.

* * * * *